US006210123B1

(12) United States Patent
Wittrisch

(10) Patent No.: US 6,210,123 B1
(45) Date of Patent: Apr. 3, 2001

(54) JET PUMPING DEVICE

(75) Inventor: Christian Wittrisch, Rueil Malmaison (FR)

(73) Assignee: Institut Francais du Petrole, Rueil-Malmaison Cedex (FR)

( * ) Notice: Subject to any disclaimer, the term of this patent is extended or adjusted under 35 U.S.C. 154(b) by 0 days.

(21) Appl. No.: 09/468,336

(22) Filed: Dec. 21, 1999

(30) Foreign Application Priority Data

Dec. 23, 1998 (FR) ..... 98 16414

(51) Int. Cl.[7] ..... F04F 5/00
(52) U.S. Cl. ..... 417/194; 417/198
(58) Field of Search ..... 417/151, 194, 417/198

(56) References Cited

U.S. PATENT DOCUMENTS

| | | | | |
|---|---|---|---|---|
| 92,313 | * | 7/1869 | Hughes | 417/194 |
| 541,781 | * | 6/1895 | Wheeler | 417/194 |
| 1,739,600 | * | 12/1929 | Loth | 417/182 |
| 2,306,727 | | 12/1942 | Hill . | |
| 3,134,338 | | 5/1964 | Dodge . | |
| 5,082,426 | * | 1/1992 | Sasaki et al. | 417/198 |

FOREIGN PATENT DOCUMENTS

| | | |
|---|---|---|
| 136245 | 7/1901 | (DE) . |
| 906743 | 7/1949 | (DE) . |
| 1082970 | 1/1955 | (FR) . |
| 2097675 | 3/1972 | (FR) . |

* cited by examiner

*Primary Examiner*—Charles G. Freay
(74) *Attorney, Agent, or Firm*—Antonelli, Terry, Stout & Kraus, LLP

(57) ABSTRACT

A jet pumping device includes an injection nozzle (1) intended for injection of a working fluid, placed in a line (3) including from upstream to downstream, a substantially cylindrical barrel (4), a convergent neck (5), a mixing channel (6) and a diffuser (7). The nozzle is placed at the end of a nozzle holder (9) on the longitudinal axis of the line, the pumped fluid circulates in an annular space (3) contained between the barrel (4) and the outside of the nozzle and of the nozzle holder, and the orifice of the nozzle has the longitudinal axis as the axis of symmetry. The device includes of one of the following combinations:

a) the nozzle holder has, in its inner channel, an element (21; 22) for rotating the working fluid stream in the nozzle and a mechanism (12, 13, 14) for rotating the nozzle around the longitudinal axis, the mechanism being independent of the energy of the working fluid or of the pumped fluid, the nozzle rotating in the opposite direction to the direction of rotation of the working fluid stream;

b) the nozzle holder has, on its outer surface, an element (24) for rotating the pumped fluid stream, such as blades inclined in relation to the longitudinal axis;

c) the nozzle holder has, on its outer surface, an element for rotating the pumped fluid stream, such as blades inclined in relation to the longitudinal axis and, in its inner channel, an element for rotating the working fluid stream in the nozzle.

9 Claims, 5 Drawing Sheets

JET PUMPING DEVICE

BACKGROUND OF THE INVENTION

The present invention relates to a jet pumping device whose efficiency is improved in relation to known jet pumps.

The continuous jet pump works according to the principle of injection of a working fluid through a calibrated restriction (nozzle) leading to a high-velocity jet along the axis of a mixing neck. The jet carries along and mixes with the fluid to be pumped according to the momentum exchange principle. The velocity at the mixer outlet is converted to pressure in a divergent channel that follows the mixing neck.

The present invention improves pumping efficiencies by acting on the circulation of the pumped fluid and/or of the working fluid.

This type of pump can be used notably in petroleum effluent production, whether in surface installations or in bottomhole installations.

The advantages afforded by improved-efficiency jet pumps can be:

no or very few parts in motion, all fluid types can be pumped (liquids, gases, viscous liquids or liquids containing solids) from a liquid working fluid (water, oil, . . . ), their size is relatively compact and compatible with the dimensions of an oil well or of a delivery pipe.

SUMMARY OF THE INVENTION

The present invention thus relates to a fluid jet pumping device comprising an injection nozzle intended for injection of a working fluid, placed in a line comprising, from upstream to downstream, a substantially cylindrical barrel, a convergent neck, a mixing channel and a diffuser, said nozzle is placed at the end of a nozzle holder on the longitudinal axis of said line, the pumped fluid circulates in the annular space contained between the barrel and the outside of the nozzle and of the nozzle holder, the orifice of the nozzle has the longitudinal axis as the axis of symmetry. According to the invention, the device consists of one of the following combinations:

a) the nozzle holder comprises, in its inner channel, means for rotating the working fluid stream in the nozzle and means for rotating the nozzle around the longitudinal axis, said rotation means being independent of the energy of the working fluid or of the pumped fluid, the nozzle rotating in the opposite direction to the direction of rotation of the working fluid stream;

b) the nozzle holder comprises, on the outside, means for rotating the pumped fluid stream, such as blades inclined in relation to the longitudinal axis;

c) the nozzle holder comprises, on the outside, means for rotating the pumped fluid stream, such as blades inclined in relation to the longitudinal axis and, in its inner channel, means for rotating the working fluid stream in the nozzle.

In a first variant concerning combinations b) and c), the nozzle of the device can be static.

In a second variant concerning combinations b) and c), the nozzle can comprise external rotation means independent of the energy of the working fluid or of the pumped fluid.

In the previous variant, the nozzle can rotate in the opposite direction to the direction of rotation of the working fluid stream.

In the device according to the invention, the means for rotating the pumped fluid stream can consist of a series of blades evenly distributed on the outside of the nozzle holder and inclined in relation to the longitudinal axis at an angle ranging between 10 and 50 degrees.

The direction of rotation of the pumped fluid stream can be identical to the direction of rotation of the assembly consisting of the nozzle and of the nozzle holder.

The means for rotating the working fluid stream can consist of a flat strip whose width is substantially equal to the inside diameter of the nozzle holder channel, said strip being helical in said channel so as to form two helical channels. The helix pitch is possibly variable, in particular decreasing in the vicinity of the nozzle.

The means for rotating the working fluid stream can consist of a stationary turbine in the nozzle channel.

The invention relates to an application of the device for pumping an effluent from the bottom of a well to the ground surface. The invention can also be used for surface pumping of a petroleum effluent.

BRIEF DESCRIPTION OF THE DRAWINGS

Other features and advantages of the invention will be clear from reading the description hereafter of non limitative examples, with reference to the accompanying drawings wherein.

DETAILED DESCRIPTION OF THE INVENTION

Figure 1:
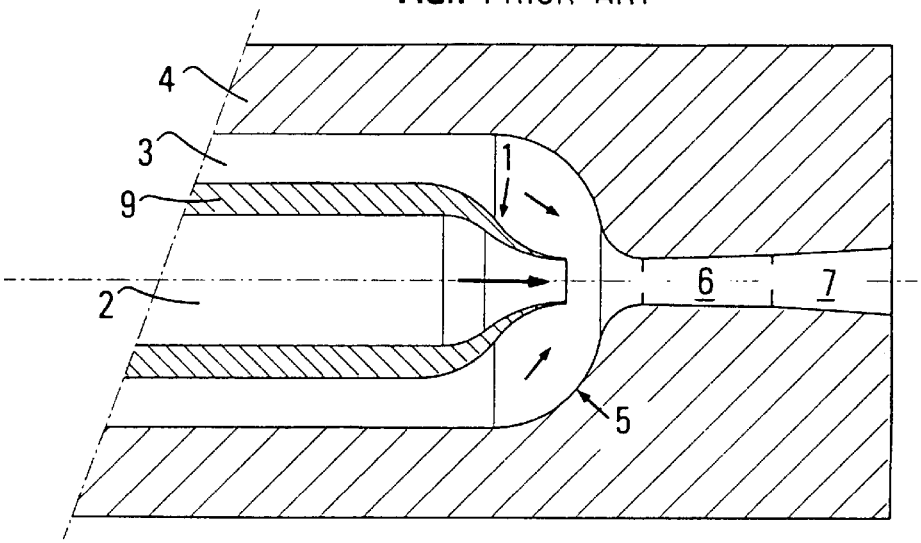
FIG.1 PRIOR ART
FIG. 1 shows a cross-section of a conventional jet pump.

FIG. 1 is a cross-sectional view of a jet pumping device according to the prior art. Such a device comprises a nozzle for injecting a working fluid such as water or oil. The inner shape of nozzle 1 is such that working fluid delivery channel 2 has a decreasing section, so that the fluid has a high velocity at the nozzle outlet. The direction of the working fluid jet thus created is substantially parallel to the axis of the nozzle. The fluid to be displaced by the pump circulates in annular space 3 between the outside of the nozzle and walls 4 of the pump barrel. Walls 4 converge at 5, substantially in the vicinity of the nozzle outlet, and form a neck. From the neck, a line 6, substantially cylindrical or very slightly conical, constitutes the working fluid and pumped fluid mixing zone. A divergent line 7 that follows the mixing line creates the pressure energy allowing displacement of the two mixed fluids.

The energy efficiency of a jet pump can be evaluated by calculating:

the dimensionless compression ratio N:

$$N=(Pref-Pasp)/(Pmot-Pref)$$

the dimensionless flow rate M:

$$M=Qasp/Qmot$$

with:

Pref=mixture delivery pressure at the pump outlet

Pasp=pumped fluid pressure at the pump inlet

Pmot=working fluid injection pressure in the vicinity of the nozzle

Qasp=flow rate of the pumped fluid

Qmot=flow rate of the working fluid.

The energy efficiency η, below 1, is equal to MN for single-phase flows or flows very close to single-phase flows.

In order to compare the performances of the different realisation variants of the invention, calculation of η will be used as a basis.

Figure 2:
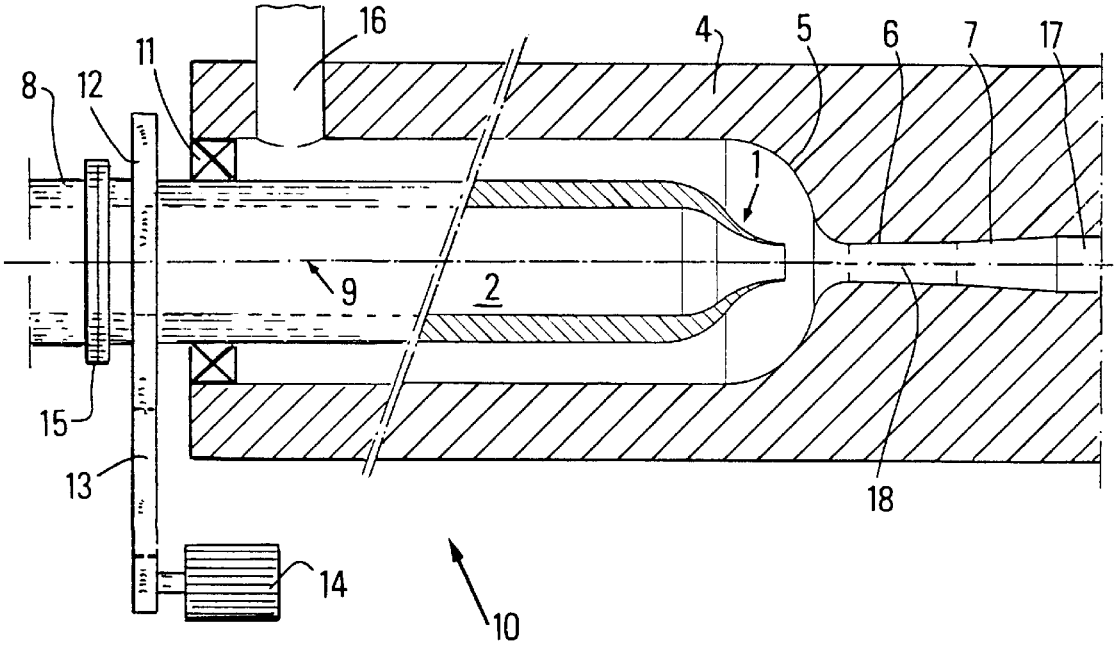
FIG. 2 diagrammatically shows the pumping device comprising means for rotating the working fluid injection nozzle.

FIG. 2 describes the testing means and the realisation principle of a pump according to the invention in the case of the different variants where nozzle 1 and its nozzle holder are driven in rotation by external means.

Reference numbers 1, 4, 6 and 7 respectively refer, as in FIG. 1, to a nozzle, a neck, a mixer and a diffuser. Line 8 supplies the nozzle with working fluid. This delivery line is stationary in relation to the pumping device. The nozzle is fastened to a nozzle holder 9 that rotates freely in relation to barrel 10 of the pump. An assembly 11 consisting of roller bearings and of rotating seals allows the assembly consisting of nozzle 1 and nozzle holder 9 to be driven in rotation by means of a pulley 12, a belt 13 and motive means 14, an electric motor for example. A rotating seal 15 connects rotating nozzle holder 9 to stationary delivery line 8. All these mechanical constituents are well-known to the man skilled in the art and are therefore not described in detail here.

Line 16 is connected to the source of fluid to be pumped, line 17 is the line delivering the mixture of pumped fluid and working fluid.

Such a device allows to rotate the nozzle around the longitudinal axis of the jet pump system, in either direction.

Figure 3A:
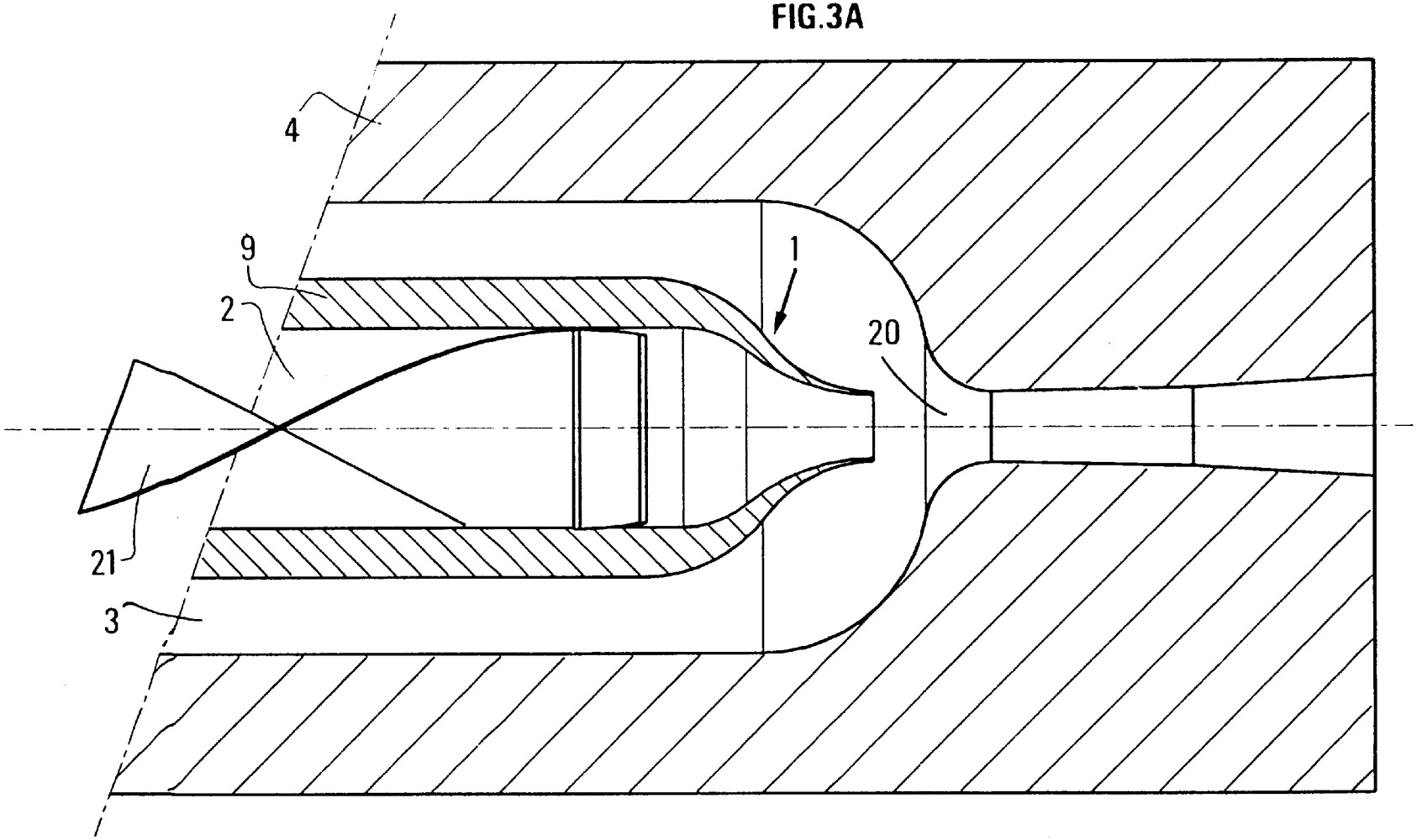
FIGS. 3*a* and 3*b* show a cross-section of a nozzle equipped with means for rotating the working fluid stream.
Figure 3B:
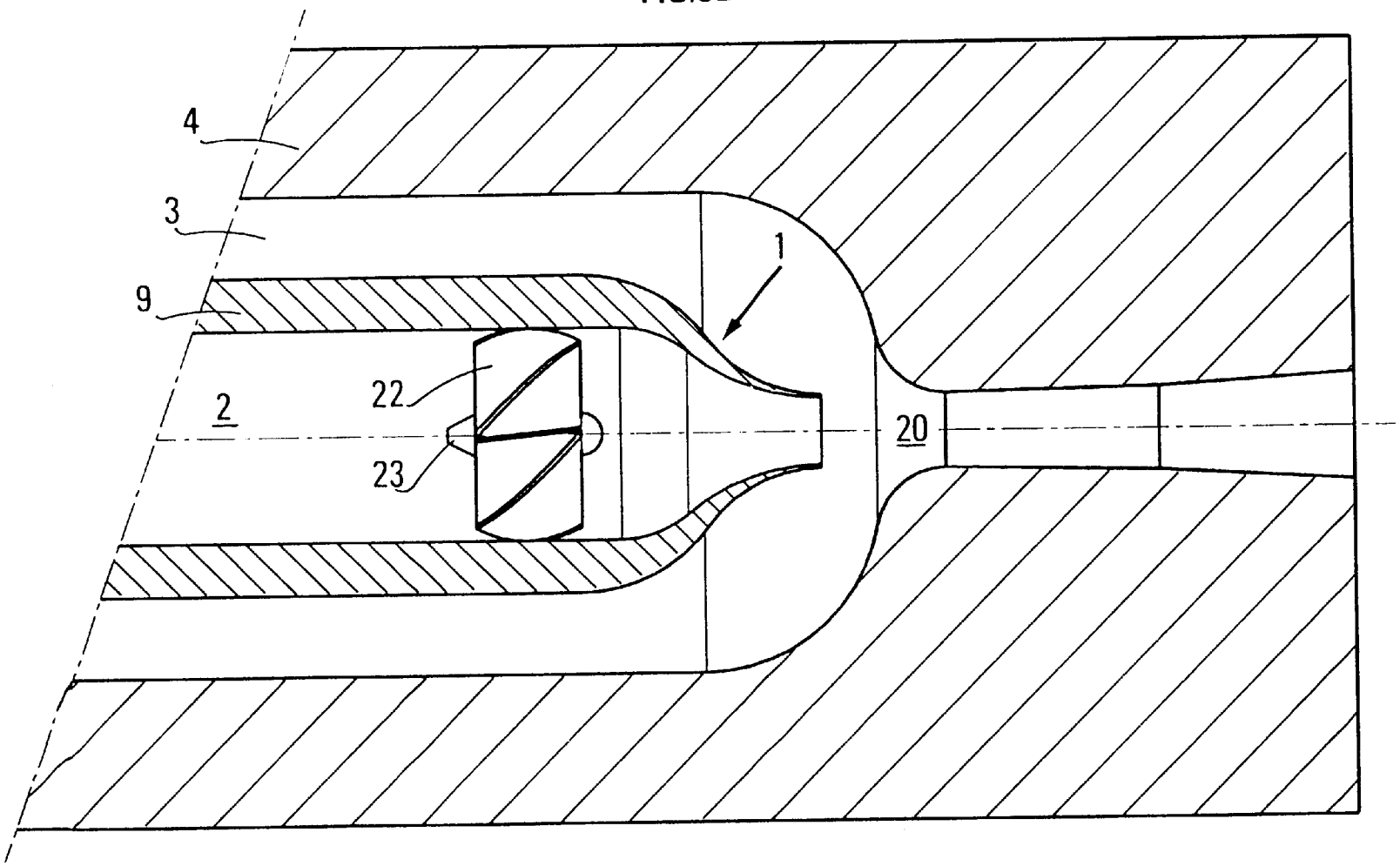

FIGS. 3*a* and 3*b* show the variant wherein the nozzle comprises internally, i.e. in working fluid channel 2, close to the end of nozzle 1, means for rotating the working fluid stream so that the jet at the nozzle outlet is always moving mainly with an axial displacement, but combined with a rotating component around the longitudinal axis. The jet thus has the same form as in the prior art, but it rotates around axis 20. These rotation means can be achieved in multiple ways. For example, a flat strip 21 splitting channel 2 in two can be placed over a length of some centimeters (about 10 cm), said strip being helically deformed so as to form two helical channels opening into the nozzle outlet upstream. The helix possibly has a variable pitch, in particular decreasing on the side close to the nozzle orifice. It is also possible to helically deform a cross-shaped section whose width corresponds to the inside diameter of the nozzle so as to create four helical channels. Other solutions can be used, for example, according to FIG. 3*b*, blades 22 inclined in relation to longitudinal axis 20 and fastened to a central core 23 so as to form a stationary turbine that will force the working fluid to rotate around the longitudinal axis.

This variant is of interest for improving the energy efficiency only if the nozzle is rotated by an external motive means independent of the working fluid energy, i.e. included in a system according to FIG. 2. The direction of rotation of the nozzle or of the nozzle holder depends on the direction of rotation of the working fluid jet. Therefore, if the helix of the inner channels of the nozzle or the blades of the turbine are substantially left-hand helices, right-hand rotation is required, or if the helices are right-hand helices, left-hand rotation of the nozzle is required.

TABLE 1

Prior art: Conventional jet pump: stationary nozzle and axial jet

| M | Efficiency η |
|---|---|
| 0.903 | 0.173 |
| 0.804 | 0.227 |
| 0.705 | 0.235 |
| 0.603 | 0.234 |
| 0.501 | 0.241 |
| 0.400 | 0.234 |
| 0.299 | 0.216 |
| 0.200 | 0.180 |

These values are used as reference values for comparison of the variants according to the invention.

The dimensions of the reference jet pump are:

nozzle and nozzle holder inside diameter=30 mm nozzle and nozzle holder outside diameter=45 mm nozzle orifice diameter=between 6 and 8 mm (6.7 mm for example)

pump barrel inside diameter=66 mm mixer neck diameter=about 12 mm mixer length=about 35 mm diffuser angle=about 3° distance between the nozzle orifice and the neck inlet=about 10 mm.

Table 2 hereafter shows the results obtained for the device according to FIG. 3 (left-hand helical channels), the nozzle being driven at the rotating speed V (rpm) (right-hand rotation).

TABLE 2

| M | Efficiency η | V (rpm) |
|---|---|---|
| 0.6030 | 0.2731 | 0 |
| 0.6263 | 0.2810 | 94 |
| 0.6453 | 0.2904 | 188 |
| 0.6346 | 0.3142 | 282 |
| 0.6540 | 0.3116 | 376 |
| 0.6638 | 0.3160 | 470 |
| 0.6618 | 0.3012 | 564 |

In relation to the configuration of the prior art, it can be noted that the efficiency increases from 0.273 (zero rotation) to 0.316 (500 rpm rotation) for values of M ranging between 0.60 and 0.66. A 0.082 gain is obtained in relation to the reference values. The efficiency gain reaches a maximum value for a rotation ranging between 280 and 500 rpm.

Figure 4:
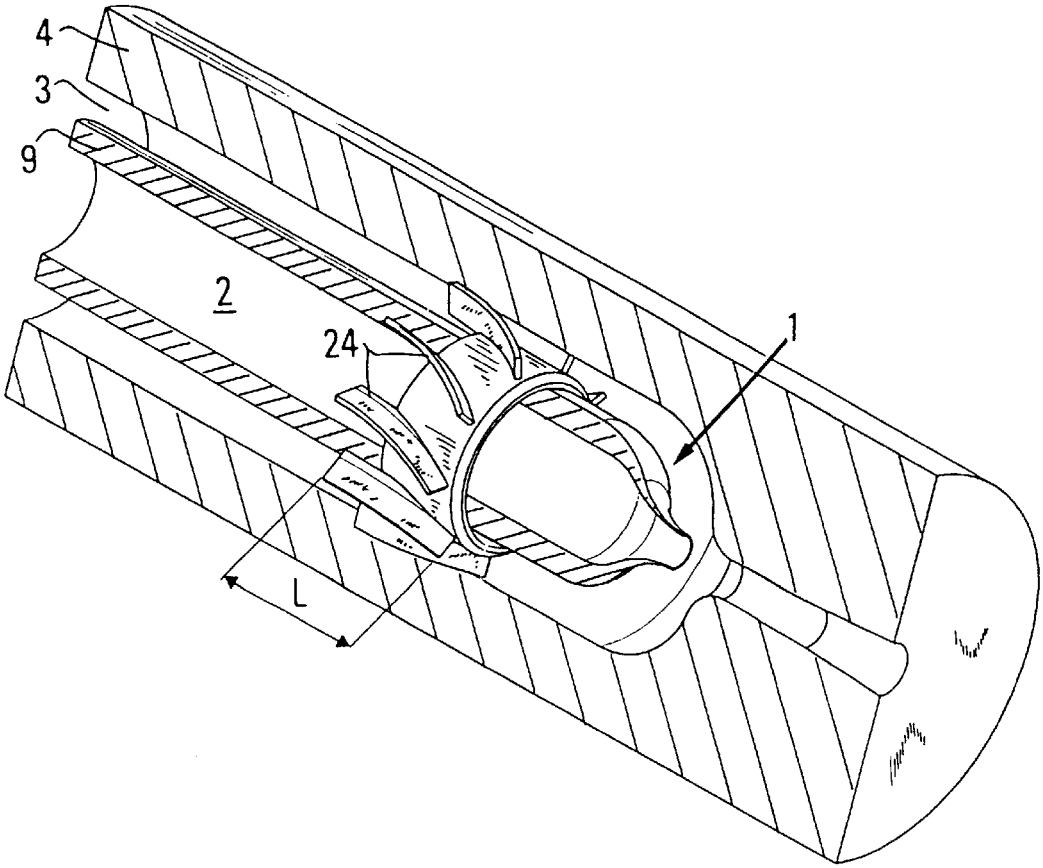
FIG. 4 shows a cross-section of a nozzle equipped, on its outer surface, with means for rotating the pumped fluid.

FIG. 4 is a perspective sectional view of another variant of the invention that consists in arranging blades 24 on the outer surface of nozzle 1 or of nozzle holder 9 so as to rotate the pumped fluid stream. FIG. 4 shows a series of blades 24 evenly arranged on the outer surface of the nozzle or of the nozzle holder, near to the neck, but before the convergent part of the nozzle. The blades can be inclined in relation to the longitudinal axis at an angle ranging between 10 and 50 degrees. The blades can consist of right-hand or left-hand helical strips. If the nozzle is stationary in relation to the pump barrel. the blades can be fastened to either barrel 4 or nozzle holder 9, or to both.

In a variant, the nozzle is rotated. The nozzle thus equipped with outer blades must rotate in the same direction as the blades helix, i.e. right-hand blades for right-hand rotation.

The test results given in Tables 3 and 4 were obtained respectively with a stationary nozzle and a nozzle rotating at a speed of 500 rpm.

The blades consist of helical vanes of length L and of a height corresponding to annular space 3 between nozzle holder 9 and barrel 4.

TABLE 3

| Outer blades, without nozzle rotation | |
|---|---|
| M | Efficiency η |
| 0.9470 | 0.1816 |
| 0.8112 | 0.2802 |
| 0.7047 | 0.2881 |
| 0.6071 | 0.2833 |
| 0.5052 | 0.2675 |
| 0.4012 | 0.2475 |
| 0.2998 | 0.2134 |

The efficiency is of the order of 0.265 for M ranging between 0.5 and 0.8. The gain is 0.047 when M is 0.6 in relation to the reference values.

TABLE 4

| Outer blades, with nozzle rotation (500 rpm) | |
|---|---|
| M | Efficiency η |
| 0.8460 | 0.1535 |
| 0.7996 | 0.3105 |
| 0.7035 | 0.3107 |
| 0.6071 | 0.2900 |
| 0.6016 | 0.2920 |
| 0.4000 | 0.2521 |
| 0.3036 | 0.2181 |

The maximum efficiency is 0.31 when M is 0.8, and 0.29 when M ranges between 0.5 and 0.8. The maximum gain is 0.09 in relation to the reference values when M is 0.8.

Figure 5A:
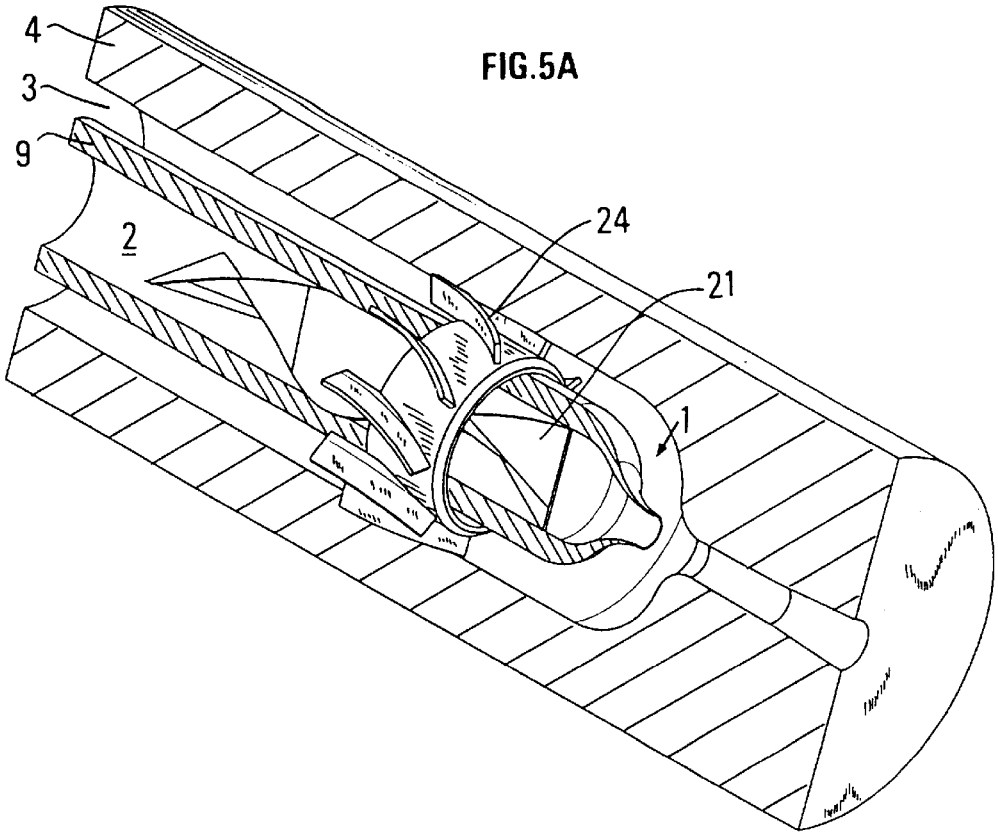
FIGS. 5 show a nozzle including the previous two variants.
Figure 5B:
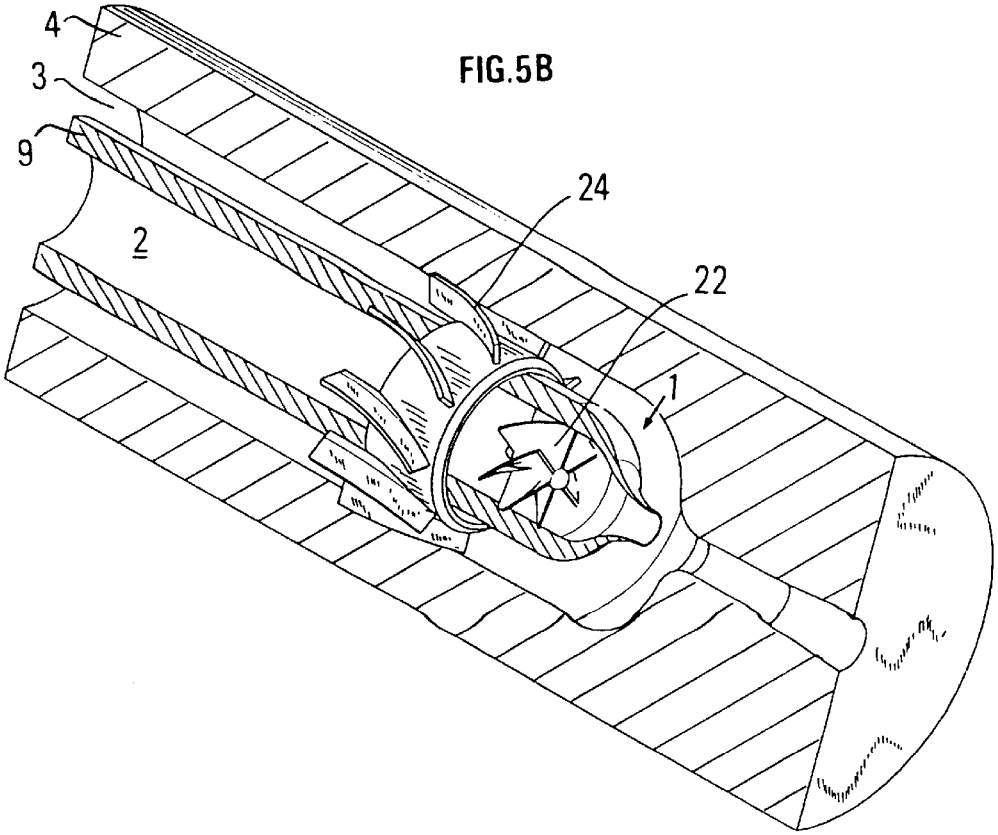

FIGS. 5*a* and 5*b* show the variant according to the invention wherein the nozzle is internally equipped with helical channels (FIG. 5*a*) or with a stationary turbine 22, and with outer blades 24. Nozzle holder 9 can be equipped with the external rotation means according to FIG. 2. Rotation is a right-hand rotation the inner channels or turbine 22 form a left-hand helix, and outer blades 24 a right-hand helix.

The results are given in Tables 5 and 6 for an assembly according to FIG. 5, with a stationary nozzle and a nozzle rotating at 500 rpm respectively.

| M | Efficiency η |
|---|---|
| 0.8460 | 0.1535 |
| 0.7996 | 0.3105 |
| 0.7035 | 0.3107 |
| 0.6071 | 0.2900 |
| 0.6016 | 0.2920 |
| 0.4000 | 0.2521 |
| 0.3036 | 0.2181 |
| 0.8479 | 0.1472 |
| 0.7837 | 0.3251 |
| 0.7084 | 0.3169 |
| 0.6035 | 0.3085 |
| 0.5047 | 0.2933 |
| 0.3866 | 0.2497 |

The maximum efficiency is 0.325 when M is 0.78 and 0.30 when M ranges between 0.4 and 0.78. The maximum gain is 0.098 in relation to the reference values when M is 0.8.

It can therefore be observed that rotation of the nozzle through external driving means independent of the working fluid or pumped fluid energy improves the efficiency of jet pumps. Surprisingly, rotation of the pumped fluid and/or of the working fluid also noticeably improves the efficiency of this type of pump.

What is claimed is:

1. A fluid jet pumping device comprising an injection nozzle for injecting a working fluid, placed in a line comprising, from upstream to downstream, a substantially cylindrical barrel, a convergent neck, a mixing channel and a diffuser, said nozzle being situated at the end of a nozzle holder on the longitudinal axis of said line, the pumped fluid circulating in an annular space contained between the barrel and an outside of the nozzle and of the nozzle holder, an orifice of the nozzle having the longitudinal axis as the axis of symmetry, the nozzle holder comprising, on its outer surface, means for rotating the pumped fluid stream, and the nozzle holder comprising means for rotating the nozzle, external and independent of the working fluid or pumped fluid energy.

2. A pumping device as claimed in claim 1, wherein the nozzle holder further comprises, in its inner channel, means for rotating the working fluid stream in the nozzle.

3. A device as claimed in claim 1, wherein the nozzle rotates in the opposite direction to the direction of rotation of the working fluid stream.

4. A device as claimed in claim 1, wherein the means for rotating the pumped fluid stream consist of a series of blades evenly distributed on the outside of the nozzle holder and inclined in relation to the longitudinal axis at an angle ranging between 10 and 50 degrees.

5. A device as claimed in claim 1, wherein the direction of rotation of the pumped fluid stream is identical to the direction of rotation of the assembly consisting of the nozzle and the nozzle holder.

6. A device as claimed in any one of claim 1, wherein the means for rotating the working fluid stream consist of a turbine fixed in the nozzle channel.

7. A fluid jet pumping device comprising an injection nozzle for injecting a working fluid, placed in a line comprising, from upstream to downstream, a substantially cylindrical barrel, a convergent neck a mixing channel and a diffuser, said nozzle being situated at the end of the nozzle holder on the longitudinal axis of said line, the pumped fluid circulating in an annular space contained between the barrel and an outside of the nozzle and of the nozzle holder, an orifice of the nozzle having the longitudinal axis as the axis of symmetry, the nozzle holder comprising, in an inner channel, means for rotating the working fluid stream in the nozzle and the nozzle holder further comprising nozzle rotation means for rotating the nozzle around the longitudinal axis, said nozzle rotation means being independent of the working fluid or pumped fluid energy, the nozzle rotating in the opposite direction to the direction of rotation of the working fluid stream, wherein the means for rotating the working fluid stream consist of a flat strip whose width is substantially equal to the inside diameter of the nozzle holder channel, said strip being helical in said channel so as to form two helical channels.

8. A device as claimed in claim 7, wherein said helical strip has a variable pitch.

9. A device as claimed in claim 8 wherein said variable pitch is decreasing in the vicinity of the nozzle orifice.

* * * * *